United States Patent [19]

Schmidt

[11] 4,113,152

[45] Sep. 12, 1978

[54] ADHESIVE DISPENSING DEVICE

[76] Inventor: Robert W. Schmidt, 5744 W. 77th St., Oak Lawn, Ill. 60459

[21] Appl. No.: 777,022

[22] Filed: Mar. 14, 1977

[51] Int. Cl.[2] ..... B05C 5/02

[52] U.S. Cl. ..... 222/485; 118/411; 222/504; 222/544; 251/61.1

[58] Field of Search ..... 118/25, 411, 412; 251/5, 61.1; 222/504, 485, 544, 334, 575, 372

[56] References Cited

U.S. PATENT DOCUMENTS

| | | | |
|---|---|---|---|
| 3,057,376 | 10/1962 | Aguffer et al. | 251/61.1 X |
| 3,190,259 | 6/1965 | Craig et al. | 118/411 X |
| 3,286,689 | 11/1966 | Ziemba | 118/411 |
| 3,727,804 | 4/1973 | Smith | 222/372 X |

*Primary Examiner*—Robert B. Reeves
*Assistant Examiner*—David A. Scherbel
*Attorney, Agent, or Firm*—Kinzer, Plyer, Dorn & McEachran

[57] ABSTRACT

A device for dispensing adhesive includes a thin member having a plurality of adhesive dispensing openings extending therethrough. There is a passage for supplying adhesive to said openings. An inflatable tube is positioned in the passage and, when inflated, is positioned against said openings to prevent the flow of adhesive therethrough.

8 Claims, 5 Drawing Figures fig.1.
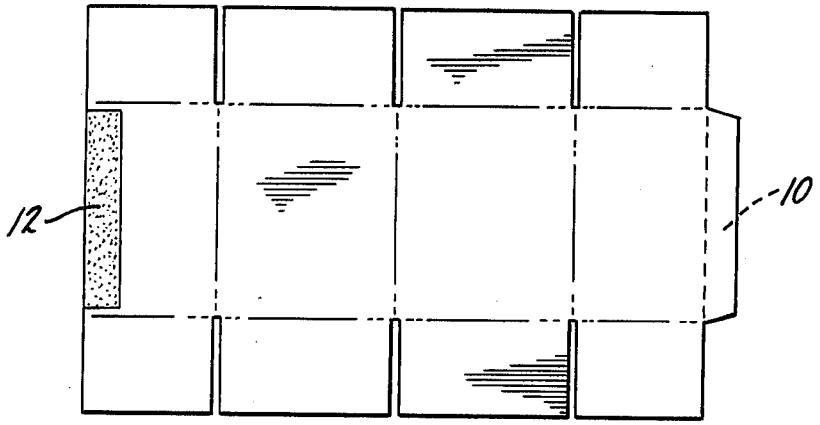
fig.2.
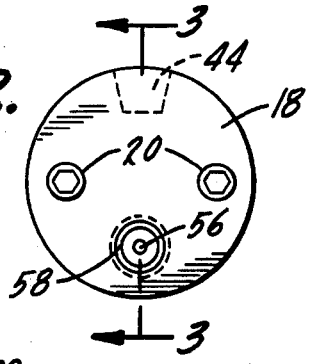
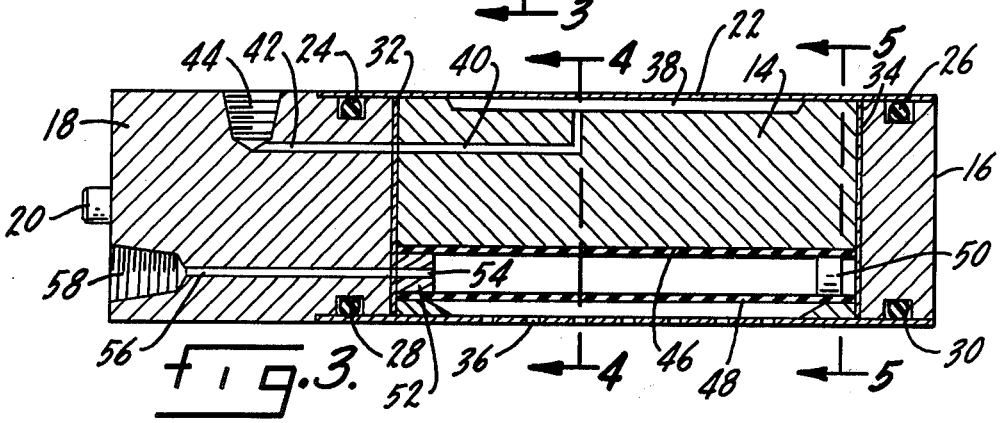
fig.3.
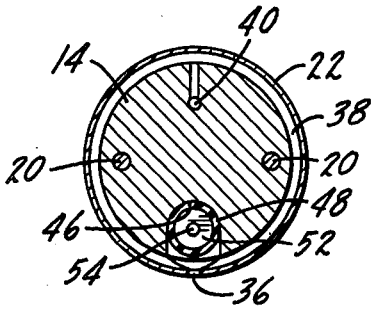
fig.4.
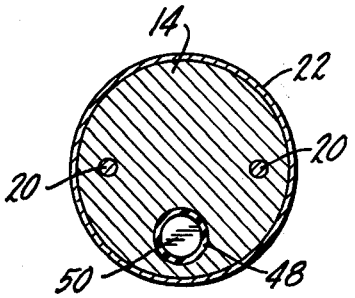
fig.5.

ADHESIVE DISPENSING DEVICE

SUMMARY OF THE INVENTION

The present invention relates to a means for dispensing adhesive, for example in the manufacture of corrugated boxes.

A primary purpose is a dispensing mechanism of the type described which will not clog after closure.

Another purpose is an adhesive dispensing apparatus which utilizes a thin sleeve as the dispensing member and which closes off the flow of adhesive directly adjacent the point of adhesive application.

Another purpose is a simply constructed reliably operable adhesive dispensing apparatus which uses a replaceable member to shut off the flow of adhesive at the point of application.

Another purpose is an adhesive dispensing apparatus utilizing an inflatable tube as a valve member to stop the flow of adhesive.

Another purpose is an adhesive dispensing apparatus providing extremely short adhesive passages which minimize plugging.

Another purpose is a quick operating adhesive dispensing apparatus having no moving parts.

Another purpose is an adhesive dispensing apparatus utilizing a replaceable sleeve to change the adhesive pattern.

Another purpose is an adhesive dispensing apparatus having long life and minimum wear to the parts.

Other purposes will appear in the ensuing specification, drawings and claims.

BRIEF DESCRIPTION OF THE DRAWINGS

The invention is illustrated diagrammatically in the following drawings wherein:

FIG. 1 is a perspective of a corrugated box blank illustrating points of adhesive application, FIG. 2 is an end view of the adhesive dispensing apparatus, FIG. 3 is an axial section along line 3—3 of FIG. 2, FIG. 4 is a section along plane 4—4 of FIG. 3, and FIG. 5 is a section along plane 5—5 of FIG. 3.

DESCRIPTION OF THE PREFERRED EMBODIMENT

In the manufacture of corrugated boxes, customarily a box blank will enter a printer-slotter as a rectangle and emerge scored and slotted, as illustrated in FIG. 1, ready for a subsequent assembly operation. As a blank emerges from a printer-slotter, adhesive is applied either to the bottom of the flap, as at 10, or to the panel to which the flap 12 is joined to form a box. The box is normally folded into a flattened tube for convenience in shipping.

The speed at which the box emerges from the printer-slotter may vary from about 100 feet per minute to approximately 1200 feet per minute. In standard systems now in use, adhesive is applied to the bottom of the flap 10 by a wheel running at approximately material speed, which wheel essentially prints the adhesive on the bottom of the flap. Such a wheel uses more adhesive than necessary for good adhesion, only because it is difficult to control the amount of adhesive applied to the box. This lengthens setting time of the glue and, of course, increases the cost of gluing. The amount of glue applied per unit of time should be adjustable so as to provide a uniform amount of glue per unit of length as the machine changes speed. This is very difficult, or impossible, with the described wheel.

A further disadvantage of the wheel applicator is that often corners of corrugated board, cut out by the printer-slotter, fly out of the slotter and are frequently trapped between the glue wheel and the box blank, thus spoiling the glue joint.

In spite of these shortcomings, this method has been in use for many years, but the need has existed for a device which will apply glue either to the bottom of the flap 10 or the top of the panel 12, to which it will be glued, in an economical and efficient way. Ideally, such a device should apply adhesive accurately to the desired area; it should be automatically adjustable to correlate the amount of adhesive applied with the speed of the box and be designed for automatic closure and automatic control of the volume of adhesive dispensed. Unless the adhesive is accurately applied, any application wider than necessary causes an undesirable adhesion to adjacent faces when the box is formed into a flattened tube. In like manner, unless the flow of adhesive can be automatically adjusted in accordance with the speed of the box, either too much adhesive is applied at low speeds, or too little adhesive is applied at high speed, with predictable results.

An attempt has been made to spray adhesive on the box blank, however, such attempts have been largely unsuccessful. The adhesive can either be sprayed through the use of air pressure as the atomizing agent or the adhesive can be sprayed by applying extemely high pressures to the adhesive itself. In either case, adhesive is carried by the atomizing air or simply because it is finely atomized, to adjacent surfaces, such as nearby machines, causing housekeeping problems, or it may be inhaled by operators and constitute a health problem.

The most desirable method from the standpoint of accurate adhesive application is to extrude narrow beads of adhesive directly on the box blank as it moves under the applicator. Existing equipment for extruding such adhesive or glue beads has the disadvantage of having the control valve a substantial distance from the point of application with the result that it is difficult to stop the flow of adhesive at the point of application accurately and the holes of the applicator tend to clog, particularly when the machinery is stopped for a period of time permitting the glue to dry in the applicating holes. There is also a tendency for fibers from the paper to enter the applicator holes and assist in the plugging-up process. In those cases where it is desirable to apply a narrower or wider strip of glue, the entire applicator head must be changed.

Since it is desirable to start and stop the glue flow accurately if the position of the glue area is to be accurate, the applicator valve must open and close quickly with repeatable operating time kept at an absolute minimum. The valve should have a minimum of glue exposed to air when the valve is closed to minimize the tendency of the glue to dry and clog in the glue passages during periods when the valve is not in use. It is often desirable to change the width of the glue pattern, and the valve of the present invention provides an inexpensive replaceable sleeve for changing glue patterns or easy replacement should the sleeve wear from contact with the board blanks.

Looking particularly at FIGS. 2–5, the applicator valve includes a core 14, generally cylindrical in form, and held to an adjacent end cap 16 and a manifold 18 by means of bolts or the like 20 which pass through the entire assembly. A thin sleeve 22 surrounds core 14 and has its ends extending over end cap 16 and manifold 18. O-ring seals 24 and 26 positioned in grooves 28 and 30 in the manifold and end cap, respectively, form a seal between the sleeve and the end members of the overall housing or applicator valve. Gaskets 32 and 34 are positioned between manifold 18 and core 14 and between core 14 and end cap 16. Gasket 32 will have suitable openings to accommodate the passages described hereinafter.

Sleeve 22 is preferably formed of a very thin gauge metal and will have a series of aligned openings or holes 36 which are used to apply beads of glue to a moving box blank. The number, disposition and arrangement of the holes will vary, depending upon the amount and position of the adhesive to be applied to a particular box blank.

An annular chamber 38 is formed between the exterior of core 14 and the interior of sleeve 22 and extends circumferentially about the core in an area intermediate the ends of the core. Openings 36 are in communication with chamber 38. Glue is supplied to chamber 38 through a core passage 40 and a manifold passage 42 which opens into a glue inlet port 44. Thus, glue supplied to port 44 under pressure will flow through the described passages and enter chamber 38, will flow circumferentially about core 14 and then out of openings 36 unless the openings are closed, as described hereinafter.

An elongated recess 46, illustrated particularly in FIG. 4, is formed in the core in alignment with openings 36. An inflatable tube 48, formed of rubber or plastic or a similar flexible material is positioned within recess 46 in alignment with openings 36. When tube 48 is inflated, preferably by air pressure, it will be directed, by the U shape of recess 46 to bear against and close openings 36, thus preventing the further flow of glue out of the openings. A plug 50 is positioned in one end of tube 48 and a further plug 52 is positioned in the opposite end. A hole 54 is drilled through plug 52 and is in communication with a manifold air passage 56 which in turn is in communication with a manifold air inlet port 58. Air supplied at port 58 will flow through passage 56, hole 54 and into inflatable tube 48. The plugs at either end of the tube prevent the entrance of adhesive into the tube when the tube is collapsed or deflated during the application of glue through holes 36.

Air inlet port 58 will be connected to a three-way air valve which will permit the tube to be inflated and rapidly deflated. As the adhesive supplied at port 44 will be under pressure, the deflation of tube 48 will be assisted by the pressure of the glue, thus allowing the rapid opening and closure of the valve.

In operation, glue will normally be supplied through the ports and passages described and will be present within chamber 38. The glue is under pressure and will be forced out of openings 36 which will be directly adjacent the surface of the corrugated board. It is preferred that the exterior surface of sleeve 22, and thus openings 36, be in contact with the board as this provides a more continuous glue bead. When it is desired to stop the flow of glue, tube 48 is inflated by air pressure greater than glue pressure, and the tube will rapidly move against openings 36 and thus shut off the flow of glue. The only glue which can dry during periods when the valve is closed is that within openings 36. Since sleeve 22 is formed of a thin gauge metal, it is practically impossible for sufficient glue to remain in the holes to cause the holes to clog or plug up. When the valve is to be used again, air pressure is evacuated from tube 48 and, as described above, the pressure of the glue assists in rapidly moving the tube away from openings 36, thus permitting glue to again flow out of the openings.

Of particular advantage is the fact that there are no moving parts in the valve and thus no parts subject to wearing friction. The valve has an extremely long life with the only possible wearing element being sleeve 22. This is an inexpensive element to manufacture, being simply a sleeve of thin gauge metal, and it can easily be replaced when worn. Also, a number of different sleeves with different hole patterns can be available for quick change. The extremely short glue passages minimize plugging as described above. This is made possible because the valve closure is directly adjacent the point of glue application. As there are no moving parts, only an inflatable tube functioning as a valve member, the valve can be rapidly opened and closed to accommodate boxes moving at a rather high rate of speed.

Whereas the preferred form of the invention has been shown and described herein, it should be realized that there may be many modifications, substitutions and alterations thereto.

The embodiments of the invention in which an exclusive property or privilege is claimed are defined as follows:

1. A means for dispensing adhesive including a housing, an adhesive chamber in said housing, said housing having a thin portion thereof positioned adjacent said chamber, a plurality of openings in said thin portion in communication with said chamber, an inflatable tube in said chamber adjacent said openings, air passage means in said housing in communication with said inflatable tube, said inflatable tube closing said openings when inflated, and a plug positioned at one end of said inflatable tube preventing the introduction of adhesive therein when the tube is deflated.

2. The structure of claim 1 further characterized by and including a sleeve positioned about at least a portion of said housing, said thin portion of said housing being formed by said sleeve.

3. The structure of claim 2 further characterized in that said plurality of openings are generally in alignment with the axis of said sleeve.

4. The structure of claim 2 further characterized in that said chamber extends circumferentially within said sleeve.

5. The structure of claim 2 further characterized in that said sleeve is removable from said housing.

6. The structure of claim 2 further characterized by and including an elongated recess formed in said housing in alignment with said openings, said inflatable member being positioned within said recess.

7. A means for dispensing adhesive including a core, a sleeve extending about said core, an adhesive chamber defined between said sleeve and core, a plurality of aligned adhesive dispensing openings in said sleeve in communication with said chamber, a recess in said core in alignment with said openings and in communication with said chamber, an inflatable tube positioned in said recess, with said tube, when inflated, closing said openings preventing the flow of adhesive therefrom.

8. A means for dispensing adhesive including a housing, an adhesive chamber in said housing, a sleeve positioned circumferentially about said housing with said chamber extending circumferentially within said sleeve, a plurality of openings in said sleeve in communication with said chamber, and an inflatable member in said chamber adjacent said sleeve openings, said inflatable member closing said openings when inflated.

* * * * *